US005291183A

United States Patent [19]

Chiang

[11] Patent Number: 5,291,183

[45] Date of Patent: Mar. 1, 1994

[54] MULTI-FUNCTIONAL ALARMING SYSTEM

[75] Inventor: Alan Chiang, Chuang Hwa, Taiwan

[73] Assignee: Ultrafashion Textile Co., Ltd., Chung Hwa, Taiwan

[21] Appl. No.: 28,266

[22] Filed: Mar. 9, 1993

[51] Int. Cl.[5] ..... G08B 25/08; H04R 29/00

[52] U.S. Cl. ..... 340/691; 340/384.5; 340/692; 381/56

[58] Field of Search ..... 340/692, 691, 573, 384 E; 381/56-57

[56] References Cited

U.S. PATENT DOCUMENTS 3,475,751 10/1969 Sontag et al. ..... 381/56 X
4,060,803 11/1977 Ashworth, Jr. ..... 381/56 X
4,750,036 6/1988 Martinez ..... 358/147
4,851,823 7/1989 Mori ..... 340/692 X
4,912,457 3/1990 Ladd ..... 340/692 X

*Primary Examiner*—John K. Peng
*Assistant Examiner*—Thomas J. Mullen, Jr.
*Attorney, Agent, or Firm*—Browdy and Neimark

[57] ABSTRACT

An alarm system employing a vocoder which enables the alarm system to emit not only a buzzing sound but also a human voice, the alarm system being composed of a microphone, a microphone amplifier, a vocoder, a memory, a preamplifier, a power amplifier and a speaker whereby the alarm system can emit the buzzing sound of a police car, whistle sound or human voice to enhance the burglarproof effect or serve as a fire alarm system for indicating the way to escape.

5 Claims, 3 Drawing Sheets

MULTI-FUNCTIONAL ALARMING SYSTEM

BACKGROUND OF THE INVENTION

A conventional alarm system used indoors, outdoors or in a vehicle is designed only with a buzzing function. Such alarm system emits loud noise when activated while failing to create an effective burglarproof function.

As shown in FIG. 1, the aforesaid conventional alarm system includes a low frequency oscillator 10, an audio oscillator 11, a Darlington amplifier 12, and a speaker 13, wherein the oscillating signal of the audio oscillator is modulated by the low frequency oscillator and then amplified by the Darlington amplifier. The alarm system is us usually provided with a 1.2 V power source so that the power is quite limited and the magnitude of the emitted sound cannot be stably adjusted. Moreover, the emitted sound is constant without variation and cannot be recorded. Therefore, the range of use is restricted.

SUMMARY OF THE INVENTION

It is therefore an object of this invention to provide an alarm system which can emit not only the alarm sound but also alternative sound recorded as desired. No additional amplifier is required in the above alarm system and various kinds of sound or voice can be played to meet different requirements in different situations.

According to the above object, the present invention applies a voder which enables the alarm system to emit a man's voice besides a buzzing sound. The alarm system of the present invention is composed of a microphone, a microphone amplifier, a vocoder, a memory, a preamplifier, a power amplifier and a speaker whereby the amplifier and recording/playing device used in a conventional alarm system can be deleted and only a speaker is necessary. As a result, the manufacturing cost is greatly lowered and the room which is occupied is reduced.

DETAILED DESCRIPTION OF THE PREFERRED EMBODIMENT

Figure 1:
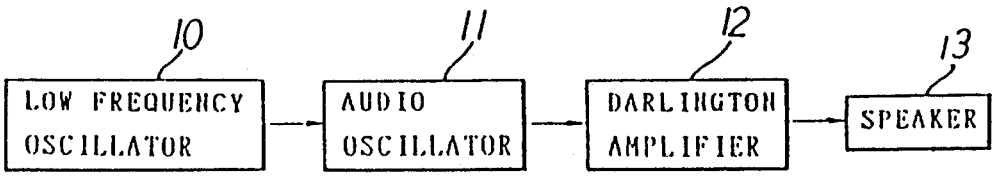
FIG.1 (PRIOR ART)
FIG. 1 is a block diagram of a conventional alarm system.
Figure 2:
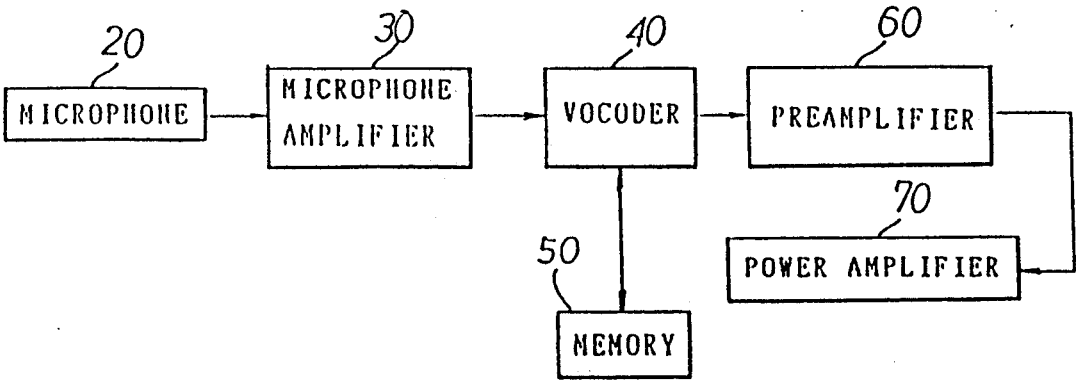
FIG. 2 is a block diagram of the present invention.
Figure 3:
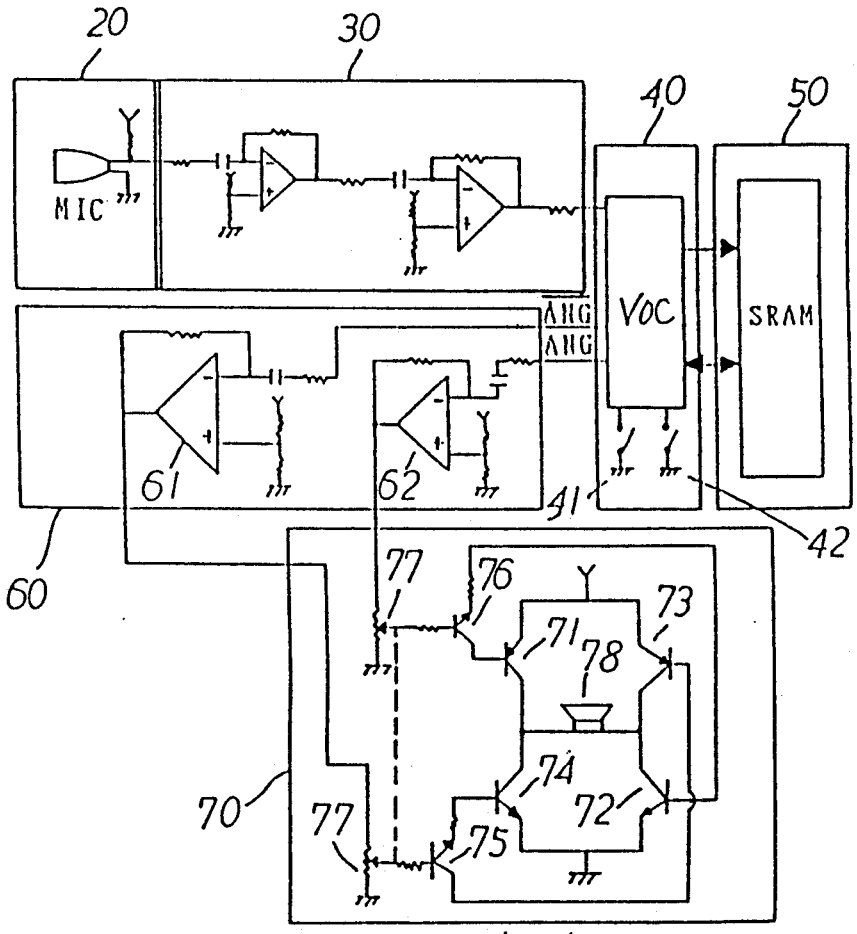
FIG. 3 is a circuit diagram of the present invention.
Figure 4:
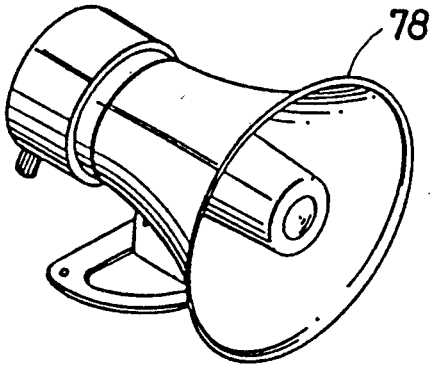
FIG. 4 is a perspective view of the present invention.
Figure 5:
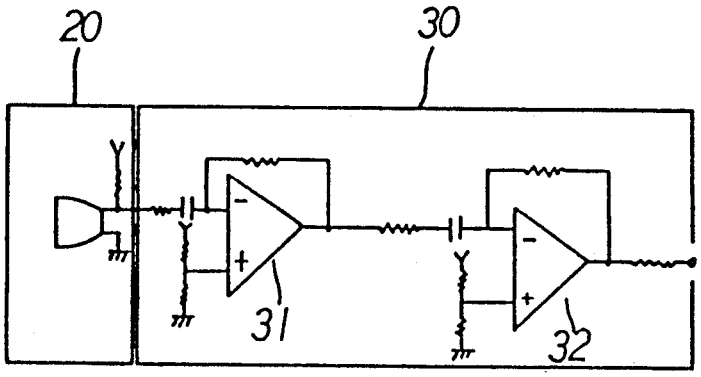
FIG. 5 is a circuit diagram of the microphone and microphone amplifier of the present invention.

Please refer to FIGS. 2, 3 and 4. The alarm system of this invention includes a microphone 20, a microphone amplifier 30, a vocoder 40, a memory 50, a preamplifier 60, a power amplifier 70 and a speaker 13, wherein the microphone and the microphone amplifier 30 (as shown in FIG. 5) is of capacitor type. The signal of the microphone 20 is amplified by two calculation amplifiers 31, 32 and then input to the vocoder 40.

Figure 6:
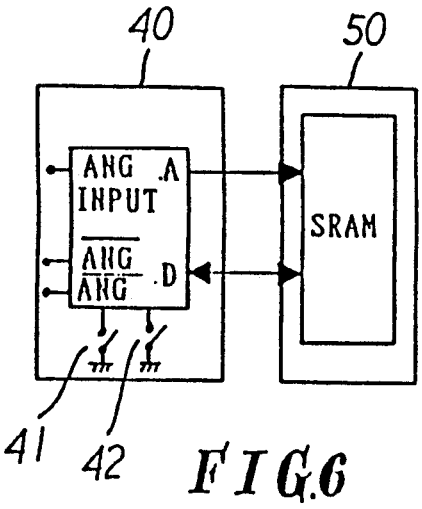
FIG. 6 is a diagram of the vocoder and memory of the present invention.

The vocoder 40 is connected to the memory 50 (as shown in FIG. 6). The vocoder 40 functions in such a manner that when a recording switch 41 is switched on, the analog signal sent from the microphone amplifier 30 is digitalized to be stored in the memory 50. The memory 50 is an SRAM so that the data can be stored for over ten years, without a power source. When the playing switch 42 is switched on, the data is retrieved from the memory 50 and converted into an analog signal to be output.

Figure 7:
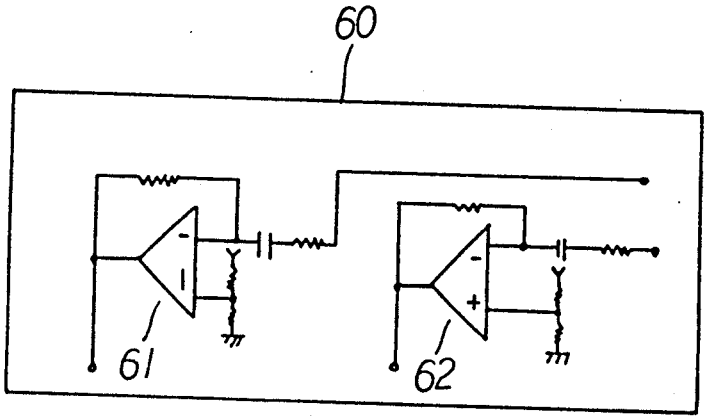
FIG. 7 is a circuit diagram of the preamplifier of the present invention.

The preamplifier 60 as shown in FIG. 7 includes two calculation amplifiers 61, 62 for respectively amplifying the positive and negative phases of the analog signal output from the vocoder 40 and sending the signal to the power amplifier 70.

Figure 8:
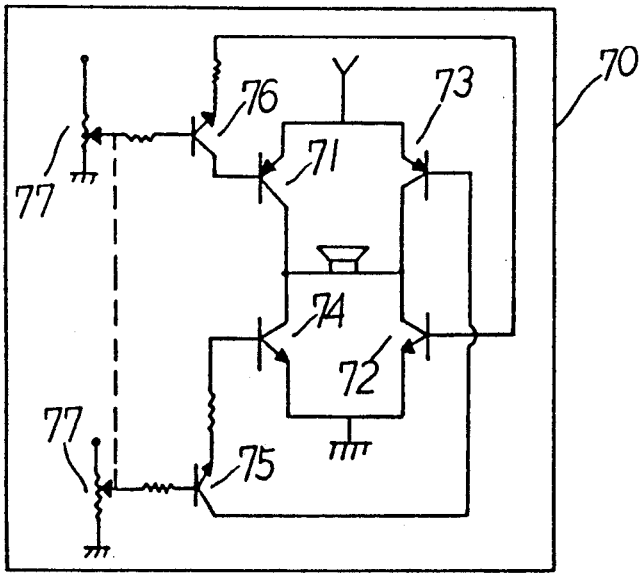
FIG. 8 is a circuit diagram of the power amplifier and speaker of the present invention.

The power amplifier 70 as shown in FIG. 8 is a bridge amplifier. The battery used in a conventional alarm system can only supply 12 V power and the amplifier for high power output is complicated with high cost. In contrast therewith, the Bridge type of amplifier can easily double the output power without complicated circuitry. The principle applied in such a bridge amplifier is as follows:

The positive phase signal output from the vocoder 40 is amplified by the calculation amplifier 62 of the preamplifier 60 and then further amplified by transistors 71, 72. The bases of transistors 71, 72 are driven by transistor 76. The negative phase signal is amplified by the calculation amplifier 61 of the preamplifier 60 and then further amplified by transistors 73, 74. The bases of the transistors 73, 74 are driven by transistor 75, whereby the peak-to-peak voltage between two ends of the speaker 78 is nearly double the voltage of the power source and thus the output power is greatly increased. A twin type of variable resistor 77 is used to adjust the output power.

The above alarm system is advantageous in that no additional amplifier or recording/playing device is required and only one speaker is needed to create high power output. Therefore, the manufacturing cost of the alarm system is very low.

The speaker of the present alarm system not only can emit alarm sound but also can produce the buzz sound of a police car, a whistle sound and a voice such as "thief! thief!". Therefore, the burglarproof effect is enhanced. The above alarm system can also serve as a fire alarm system whereby in case a fire takes place, the persons in the fire scene can be guided to run for a right place by the voice emitted from the system so as to eliminate the shortcoming of a conventional device that the persons will simply be scared by the alarm sound. The above system can further serve as a broadcasting system to changeably record/play the desired sound.

What is claimed is:

1. A multi-functional alarm system comprising a capacitive-type microphone for sensing ambient sound and providing an output responsive thereto;

a microphone amplifier for receiving the output from said microphone and for outputting analog signals representative of said ambient sound;

a vocoder for receiving said analog signals and having a memory, a recording switch and a playing switch, whereby the vocoder digitalizes said analog signals and stores the digitalized signals in said memory when said recording switch is in an ON position, and whereby the vocoder retrieves any digitalized signals stored in said memory and outputs converted analog signals having positive and negative phase components when said playing switch is in an ON position;

an audio preamplifier for receiving said converted analog signals and having two calculation amplifiers for respectively amplifying the positive and negative phase components of the converted analog signals and respectively outputting amplified positive and negative phase signals;

a power amplifier formed as a bridge circuit for receiving said amplified phase signals, further amplifying the amplified positive phase signal by means of first and second transistors and further amplifying the amplified negative phase signal by means of third and fourth transistors, the bases of the first and second transistors each being driven by a fifth transistor, the bases of the third and fourth transistors each being driven by a sixth transistor;

a speaker for providing audible sound when said playing switch is in said ON position; and twin variable resistors for adjusting the output power applied to the speaker.

2. The alarm system of claim 1 wherein said audible sound includes a sound of a human voice.

3. The alarm system of claim 1 wherein said audible sound includes a buzzing sound.

4. The alarm system of claim 1 wherein said audible sound includes a whistle sound.

5. The alarm system of claim 1 wherein said alarm system is a fire alarm system and said audible sound includes a sound of a human voice giving instructions.

* * * * *